US011430397B2

(12) United States Patent
Lin et al.

(10) Patent No.: US 11,430,397 B2
(45) Date of Patent: Aug. 30, 2022

(54) SYSTEM AND METHOD FOR COMPENSATING UNIFORMITY OF BRIGHTNESS

(71) Applicant: TPK Universal Solutions Limited, Wanchai (HK)

(72) Inventors: Ming Chuan Lin, Taichung (TW); Hsuan Kuang Chen, Taichung (TW); Su Ming Lin, Taichung (TW); Chun Hui Tseng, Changhua (TW); Wen Hung Wang, Taichung (TW)

(73) Assignee: TPK Universal Solutions Limited, Wanchai (HK)

( * ) Notice: Subject to any disclaimer, the term of this patent is extended or adjusted under 35 U.S.C. 154(b) by 0 days.

(21) Appl. No.: 17/084,697

(22) Filed: Oct. 30, 2020

(65) Prior Publication Data

US 2021/0407439 A1 Dec. 30, 2021

(30) Foreign Application Priority Data

Jun. 30, 2020 (CN) ..... 202010612491.0

(51) Int. Cl.
*G09G 3/36* (2006.01)
*G09G 3/34* (2006.01)

(52) U.S. Cl.
CPC ... *G09G 3/3406* (2013.01); *G09G 2320/0233* (2013.01); *G09G 2320/0626* (2013.01); *G09G 2360/16* (2013.01)

(58) Field of Classification Search
CPC ..... G09G 3/3406; G09G 2320/0233; G09G 2320/0626; G09G 2360/16;
(Continued)

(56) References Cited

U.S. PATENT DOCUMENTS

2012/0056905 A1* 3/2012 Nonaka ..... G09G 3/3426 345/690
2018/0075813 A1* 3/2018 Zhang ..... G09G 3/34
(Continued)

FOREIGN PATENT DOCUMENTS

CN 102954405 A 3/2013
TW M292691 U 6/2006
(Continued)

*Primary Examiner* — Jennifer T Nguyen
(74) *Attorney, Agent, or Firm* — Cooper Legal Group, LLC

(57) ABSTRACT

A system and a method for compensating uniformity of brightness are provided. The system includes an edge-type backlight assembly, a display panel, a brightness sensor, a compensating calculator, and a local dimming controller. The display panel is disposed above the edge-type backlight assembly. The display panel includes plural regions for local dimming. The brightness sensor is configured to measure whether the brightness distribution of the display panel is uniform. When the brightness distribution of the display panel is not uniform, the compensating calculator calculates a brightness compensation value corresponding to each of the regions of the display panel. The local dimming controller is configured to drive the edge-type backlight assembly according to the brightness compensation value corresponding to each of the regions of the display panel.

20 Claims, 6 Drawing Sheets

(58) Field of Classification Search
CPC ..... G09G 2310/08; G09G 2310/027; G02F 1/133611; G02F 1/133603
USPC ..... 345/102
See application file for complete search history.

(56) References Cited

U.S. PATENT DOCUMENTS

| | | | | |
|---|---|---|---|---|
| 2020/0058109 | A1* | 2/2020 | Rhyu | G09G 3/3426 |
| 2021/0181583 | A1* | 6/2021 | Kim | G06F 3/1462 |
| 2021/0201849 | A1* | 7/2021 | Choi | G09G 3/20 |

FOREIGN PATENT DOCUMENTS

| | | | |
|---|---|---|---|
| TW | 200840413 | A | 10/2008 |
| TW | 200916703 | A | 4/2009 |
| TW | I404004 | B | 8/2013 |
| TW | M607910 | U | 2/2021 |

* cited by examiner

SYSTEM AND METHOD FOR COMPENSATING UNIFORMITY OF BRIGHTNESS

RELATED APPLICATIONS

This application claims priority to China Application Serial Number 202010612491.0, filed Jun. 30, 2020, the disclosure of which is incorporated herein by reference in its entirety.

BACKGROUND

Field of Disclosure

The present disclosure relates to a liquid crystal display (LCD) apparatus. More particularly, the present disclosure relates to a system and a method for improving uniformity of brightness of an edge-type LCD apparatus.

Description of Related Art

The LCD apparatus includes a LCD panel which utilizes transmittance of liquid crystal to display images and a backlight assembly which is disposed under the LCD panel to provide the LCD panel with light. Generally, an edge-type backlight assembly is adopted to reduce a thickness of the LCD apparatus. The edge-type backlight assembly utilizes a light guide plate to guide the light of a side light bar to form a flat light source, thereby ensuring uniformity of brightness. However, during actual use, there are many factors that affect uniformity of brightness when the LCD panel displays images, thereby resulting in poor product yield. For example, the factors are: poor side light bars, an excessive difference between the luminous efficiencies of grains of the LEDs that compose the side light bars, an excessive difference between the transmittances of the liquid crystal cells, deviations between electronic components (e.g., resistors, capacitors, inductors, etc.) which result in inconsistent driving currents of LEDs, etc.

SUMMARY

In order to solve the aforementioned problems that result in poor product yield and overcome the deficiencies of the existing technologies, the purpose of the present disclosure is to provide a system for compensating uniformity of brightness. The system performs brightness compensation in a local dimming manner. The system improves uniformity of brightness of the LCD panel when the LCD panel displays images.

The present disclosure provides a system for compensating uniformity of brightness. The system includes an edge-type backlight assembly, a display panel, a brightness sensor, a compensating calculator, and a local dimming controller. The display panel is disposed above the edge-type backlight assembly. The display panel includes a plurality of regions for local dimming. The brightness sensor is configured to measure whether the brightness distribution of the display panel is uniform. When the brightness distribution of the display panel is not uniform, the compensating calculator is configured to calculate a brightness compensation value corresponding to each of the regions of the display panel. The local dimming controller is configured to drive the edge-type backlight assembly according to the brightness compensation value corresponding to each of the regions of the display panel.

In accordance with one or more embodiments of the disclosure, the local dimming controller includes a storage unit configured to store the brightness compensation value corresponding to each of the regions of the display panel.

In accordance with one or more embodiments of the disclosure, the display panel has plurality of measuring points. A method that the brightness sensor uses to measure whether the brightness distribution of the display panel is uniform includes: measuring a plurality of brightness values respectively corresponding to the measuring points which are lit up; calculating a ratio of a maximum value of the brightness values to a minimum value of the brightness values; and comparing the ratio with a uniformity threshold to determine whether the brightness distribution of the display panel is uniform.

In accordance with one or more embodiments of the disclosure, the edge-type backlight assembly includes a light guide plate, an upper light bar, and a lower light bar. The upper light bar and the lower light bar are respectively disposed on two opposite sides of the light guide plate. A light generated by the upper light bar and the lower light bar is guided to the display panel via the light guide plate. Each of the upper light bar and the lower light bar has a plurality of first light source groups and a plurality of second light source groups arranged alternately along an extending direction of the upper light bar and the lower light bar, wherein each of the first light source groups and the second light source groups includes at least one light-emitting diode (LED).

In accordance with one or more embodiments of the disclosure, the regions of the display panel include a plurality of upper odd regions corresponding to the first light source groups of the upper light bar and a plurality of upper even regions corresponding to the second light source groups of the upper light bar. The regions of the display panel further include a plurality of lower odd regions corresponding to the first light source groups of the lower light bar and a plurality of lower even regions corresponding to the second light source groups of the lower light bar.

In accordance with one or more embodiments of the disclosure, a method that the compensating calculator uses to calculate the brightness compensation value corresponding to each of the regions of the display panel includes: controlling, by the compensating calculator, the brightness sensor to measure a central point brightness value of each of the upper odd regions and the lower odd regions which is lit up; and controlling, by the compensating calculator, the local dimming controller to perform brightness compensation on one of the upper odd regions or on one of the lower odd regions so as to calculate the brightness compensation value corresponding to the one of the upper odd regions or the one of the lower odd regions when the central point brightness value of the one of the upper odd regions or the one of the lower odd regions is not equal to a standard value.

In accordance with one or more embodiments of the disclosure, after the local dimming controller performs brightness compensation on the upper odd regions and the lower odd regions, the method that the compensating calculator uses to calculate the brightness compensation value corresponding to each of the regions of the display panel further includes: controlling, by the compensating calculator, the brightness sensor to measure a central point brightness value of each of the upper even regions and the lower even regions which is lit up; and controlling, by the compensating calculator, the local dimming controller to perform brightness compensation on one of the upper even regions or on one of the lower even regions so as to calculate the brightness compensation value corresponding to the one of the upper even regions or the one of the lower even regions when the central point brightness value of the one of the upper even regions or the one of the lower even regions is not equal to the standard value.

In accordance with one or more embodiments of the disclosure, the compensating calculator controls the local dimming controller to perform brightness compensation on the one of the upper odd regions or on the one of the lower odd regions so as to allow the central point brightness value of the one of the upper odd regions or the one of the lower odd regions to be equal to the standard value. The compensating calculator controls the local dimming controller to perform brightness compensation on the one of the upper even regions or on the one of the lower even regions so as to allow the central point brightness value of the one of the upper even regions or the one of the lower even regions to be equal to the standard value.

In accordance with one or more embodiments of the disclosure, when the brightness compensation value corresponding to one of the regions of the display panel exceeds a maximum compensation range, the compensating calculator determines that a display apparatus including the edge-type backlight assembly and the display panel is unqualified.

In accordance with one or more embodiments of the disclosure, the brightness compensation value corresponding to one of the regions of the display panel is a driving current parameter of the edge-type backlight assembly.

Another purpose of the present disclosure is to provide a method for compensating uniformity of brightness. The method performs brightness compensation in a local dimming manner. The method improves uniformity of brightness of the LCD panel when the LCD panel displays images.

The present disclosure further provides a method for compensating uniformity of brightness. The method includes: measuring, by a brightness sensor, whether a brightness distribution of a display panel is uniform, wherein the display panel includes a plurality of regions for local dimming; calculating, by a compensating calculator, a brightness compensation value corresponding to each of the regions of the display panel when the brightness distribution of the display panel is not uniform; and driving, by a local dimming controller, an edge-type backlight assembly according to the brightness compensation value corresponding to each of the regions of the display panel. The display panel is disposed above the edge-type backlight assembly.

In accordance with one or more embodiments of the disclosure, the method includes storing, in a storage unit of the local dimming controller, the brightness compensation value corresponding to each of the regions of the display panel.

In accordance with one or more embodiments of the disclosure, the display panel has a plurality of measuring points. Measuring, by the brightness sensor, whether the brightness distribution of the display panel is uniform includes: measuring a plurality of brightness values respectively corresponding to the measuring points which are lit up; calculating a ratio of a maximum value of the brightness values to a minimum value of the brightness values; and comparing the ratio with a uniformity threshold to determine whether the brightness distribution of the display panel is uniform.

In accordance with one or more embodiments of the disclosure, the edge-type backlight assembly includes a light guide plate, an upper light bar, and a lower light bar. The upper light bar and the lower light bar are respectively disposed on two opposite sides of the light guide plate. The method includes guiding a light generated by the upper light bar and the lower light bar is guided to the display panel via the light guide plate. Each of the upper light bar and the lower light bar has a plurality of first light source groups and a plurality of second light source groups arranged alternately along an extending direction of the upper light bar and the lower light bar, wherein each of the first light source groups and the second light source groups includes at least one light-emitting diode (LED).

In accordance with one or more embodiments of the disclosure, the regions of the display panel include a plurality of upper odd regions corresponding to the first light source groups of the upper light bar and a plurality upper even regions corresponding to the second light source groups of the upper light bar. The regions of the display panel further include a plurality of lower odd regions corresponding to the first light source groups of the lower light bar and a plurality of lower even regions corresponding to the second light source groups of the lower light bar.

In accordance with one or more embodiments of the disclosure, calculating, by the compensating calculator, the brightness compensation value corresponding to each of the regions of the display panel includes: controlling, by the compensating calculator, the brightness sensor to measure a central point brightness value of each of the upper odd regions and the lower odd regions which is lit up; and controlling, by the compensating calculator, the local dimming controller to perform brightness compensation on one of the upper odd regions or on one of the lower odd regions so as to calculate the brightness compensation value corresponding to the one of the upper odd regions or the one of the lower odd regions when the central point brightness value of the one of the upper odd regions or the one of the lower odd regions is not equal to a standard value.

In accordance with one or more embodiments of the disclosure, after the local dimming controller performs brightness compensation on the upper odd regions and the lower odd regions, calculating, by compensating calculator, the brightness compensation value corresponding to each of the regions of the display panel further includes: controlling, by the compensating calculator, the brightness sensor to measure a central point brightness value of each of the upper even regions and the lower even regions which is lit up; and controlling, by the compensating calculator, the local dimming controller to perform brightness compensation on one of the upper even regions or on one of the lower even regions so as to calculate the brightness compensation value corresponding to the one of the upper even regions or the one of the lower even regions when the central point brightness value of the one of the upper even regions or the one of the lower even regions is not equal to the standard value.

In accordance with one or more embodiments of the disclosure, the compensating calculator controls the local dimming controller to perform brightness compensation on the one of the upper odd regions or on the one of the lower odd regions so as to allow the central point brightness value of the one of the upper odd regions or the one of the lower odd regions to be equal to the standard value. The compensating calculator controls the local dimming controller to perform brightness compensation on the one of the upper even regions or on the one of the lower even regions so as to allow the central point brightness value of the one of the upper even regions or the one of the lower even regions to be equal to the standard value.

In accordance with one or more embodiments of the disclosure, when the brightness compensation value corresponding to one of the regions of the display panel exceeds a maximum compensation range, the method includes determining, by the compensating calculator, that a display apparatus including the edge-type backlight assembly and the display panel is unqualified.

In accordance with one or more embodiments of the disclosure, the brightness compensation value corresponding to one of the regions of the display panel is a driving current parameter of the edge-type backlight assembly.

The beneficial effect achieved by the technical solution of the present disclosure is to perform brightness compensation for repairing products with poor uniformity of brightness, optimize a maximum brightness of the product, and improve the contrast and the uniformity of brightness of the LCD panel when the LCD panel displays images.

In order to let above mention of the present disclosure and other objects, features, advantages, and embodiments of the present disclosure to be more easily understood, the description of the accompanying drawing as follows.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Specific embodiments of the present disclosure are further described in detail below with reference to the accompanying drawings, however, the embodiments described are not intended to limit the present disclosure, and it is not intended for the description of operation to limit the order of implementation. The using of "first", "second", "third", etc. in the specification should be understood for identify units or data described by the same terminology, but are not referred to particular order or sequence.

Figure 1:
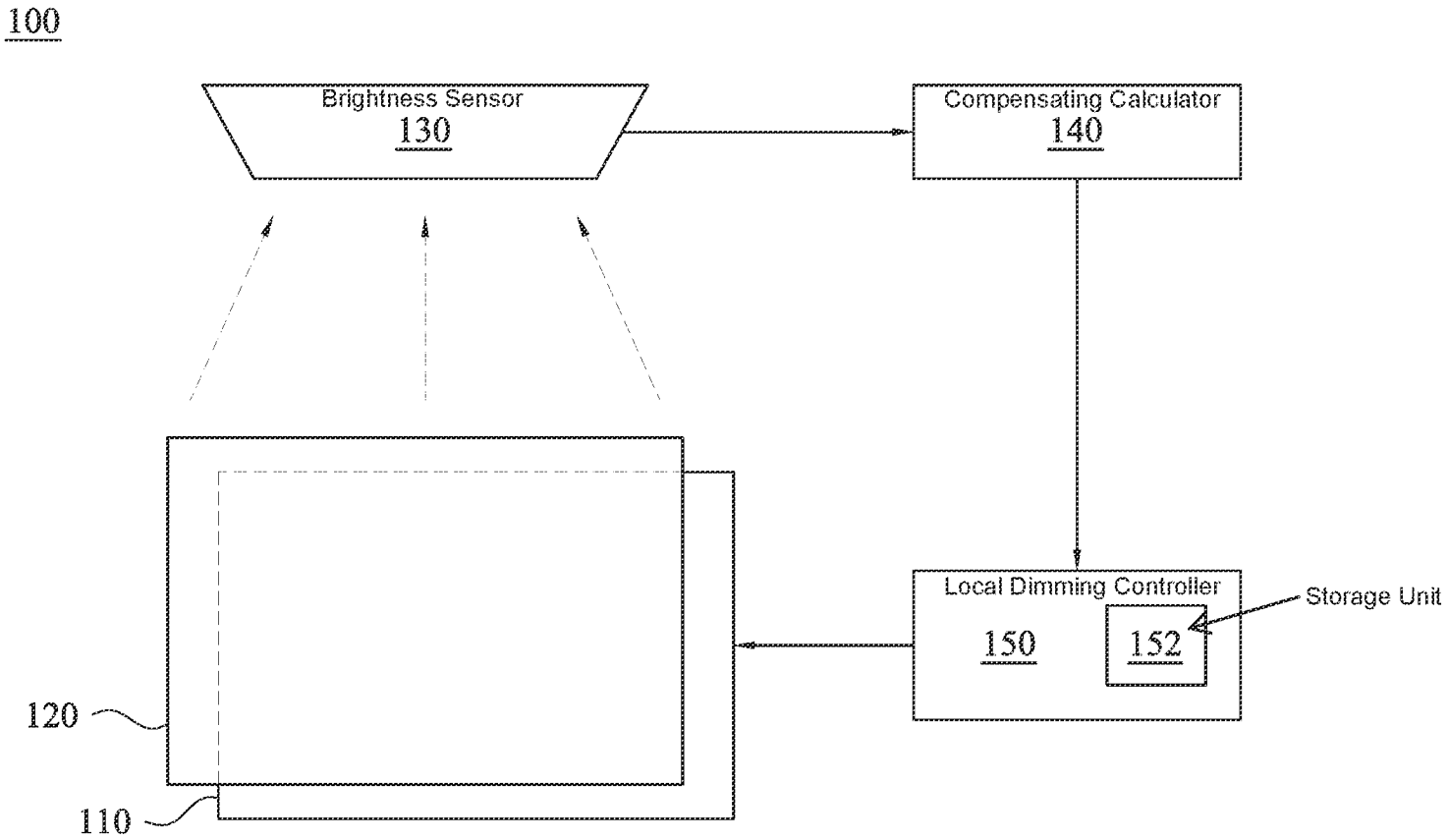
FIG. 1 illustrates a diagram of a system for compensating uniformity of brightness according to some embodiments of the present disclosure.

FIG. 1 illustrates a diagram of a system 100 for compensating uniformity of brightness according to some embodiments of the present disclosure. The system 100 includes an edge-type backlight assembly 110, a display panel 120, a brightness sensor 130, a compensating calculator 140, and a local dimming controller 150. The display panel 120 is disposed above the edge-type backlight assembly 110. The display panel 120 may be a liquid crystal display (LCD) panel.

Figure 2:
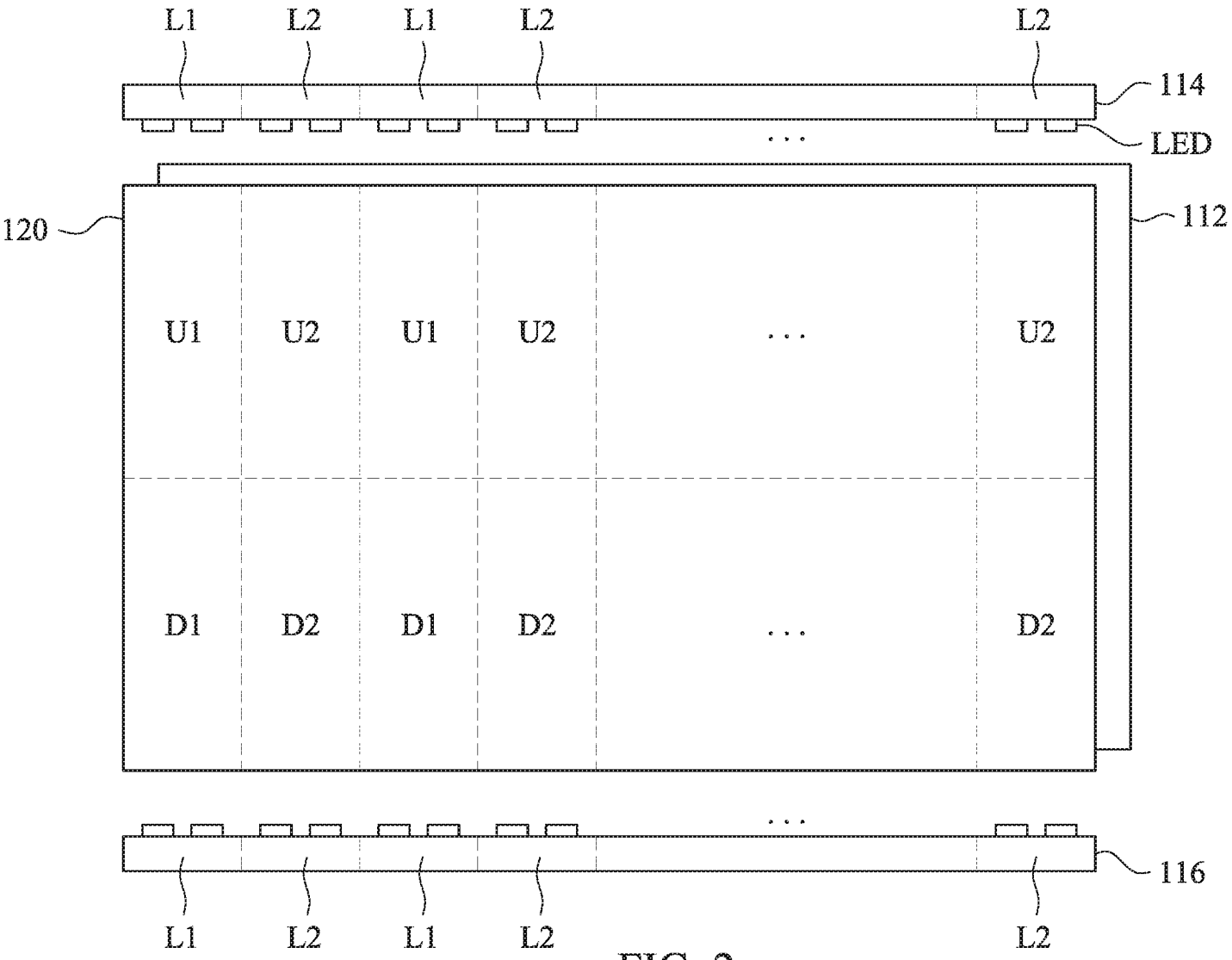
FIG. 2 illustrates a diagram of an edge-type backlight assembly and a display panel of the system for compensating uniformity of brightness according to some embodiments of the present disclosure.

FIG. 2 illustrates a diagram of the edge-type backlight assembly 110 and the display panel 120 of the system 100 for compensating uniformity of brightness according to some embodiments of the present disclosure. The edge-type backlight assembly 110 includes a light guide plate 112, an upper light bar 114, and a lower light bar 116. The upper light bar 114 and the lower light bar 116 are respectively disposed on two opposite sides of the light guide plate 112. The upper light bar 114 has plural first light source groups L1 and plural second light source groups L2 arranged alternately along an extending direction of the upper light bar 114. The lower light bar 116 has plural first light source groups L1 and plural second light source groups L2 arranged alternately along an extending direction of the lower light bar 116. It is worth mentioning that the present disclosure does not limit the number and the location of the light bars of the edge-type backlight assembly 110. In other words, the number of the light bars of the edge-type backlight assembly 110 may also be 1, 4, or more than 4, and the location of the light bars of the edge-type backlight assembly 110 may also be disposed on the left side and/or the right side of the light guide plate 112.

As shown in FIG. 2, each of the first light source groups L1 and the second light source groups L2 of the upper light bar 114 and the first light source groups L1 and the second light source groups L2 of the lower light bar 116 includes two light-emitting diodes (LEDs), but the present disclosure is not limited thereto. In some embodiments of the present disclosure, each of the first light source groups L1 and the second light source groups L2 of the upper light bar 114 and the first light source groups L1 and the second light source groups L2 of the lower light bar 116 includes at least one light-emitting diode (LED). The edge-type backlight assembly 110 guides the light generated by the LEDs of the upper light bar 114 and the lower light bar 116 to the display panel 120 via the light guide plate 112.

As shown in FIG. 2, the display panel 120 includes plural regions for local dimming. Specifically, the regions of the display panel 120 include plural upper odd regions U1 corresponding to the first light source groups L1 of the upper light bar 114, plural upper even regions U2 corresponding to the second light source groups L2 of the upper light bar 114, plural lower odd regions D1 corresponding to the first light source groups L1 of the lower light bar 116, and plural lower even regions D2 corresponding to the second light source groups L2 of the lower light bar 116.

As shown in FIG. 1, the brightness sensor 130 is configured to measure whether the brightness distribution of the display panel 120 is uniform when the display panel 120 displays a white picture. In some embodiments of the present disclosure, the brightness sensor 130 may be an optical measuring lens. The compensating calculator 140 receives the measuring result from the brightness sensor 130. The compensating calculator 140 is configured to calculate a brightness compensation value corresponding to each of the regions of the display panel 120 when the brightness distribution of the display panel 120 is not uniform. The local dimming controller 150 is configured to drive the edge-type backlight assembly 110 in a local dimming manner according to the brightness compensation value corresponding to each of the regions of the display panel 120.

Figure 3:
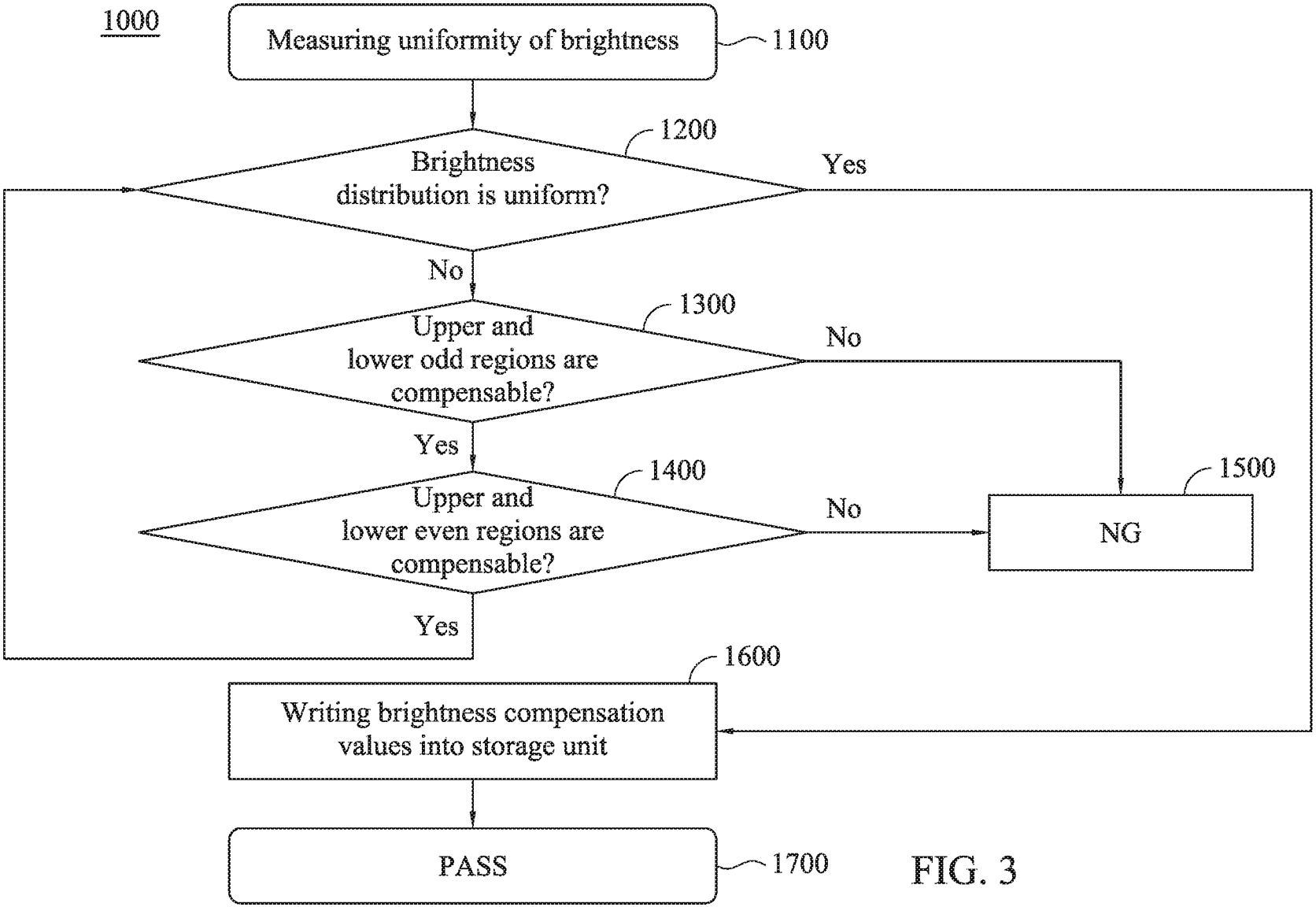
FIG. 3 illustrates a flow chart of a method for compensating uniformity of brightness according to some embodiments of the present disclosure.

FIG. 3 illustrates a flow chart of a method 1000 for compensating uniformity of brightness according to some embodiments of the present disclosure. The method 1000 is implemented by the system 100. The method 1000 includes steps 1100-1700. Please refer to FIGS. 1 to 3. In step 1100, the brightness sensor 130 measures the uniformity of brightness of the display panel 120 when the display panel 120 displays the white picture.

Figure 4A:
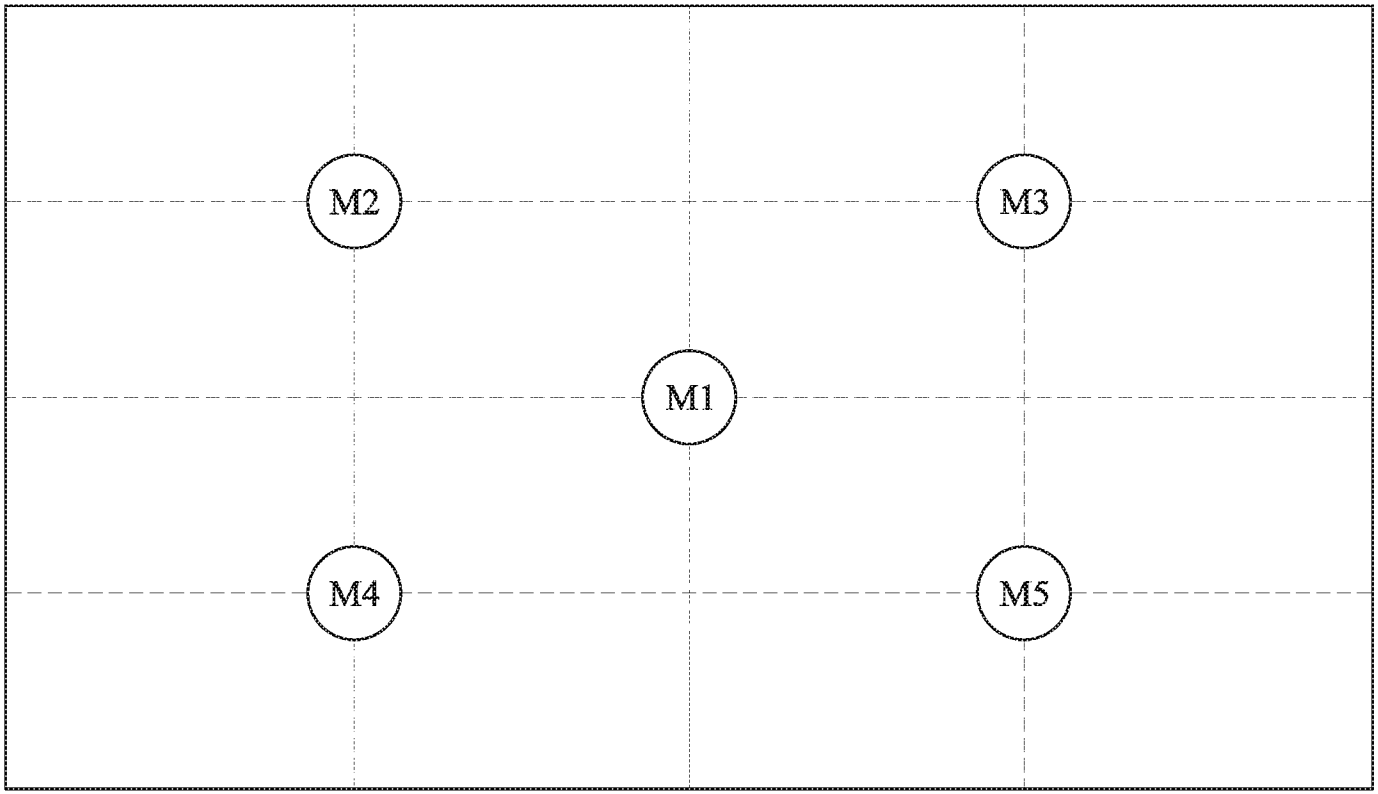
FIG. 4*a* and FIG. 4*b* illustrate diagrams of a method for measuring uniformity of brightness of the display panel according to some embodiments of the present disclosure.
Figure 4B:
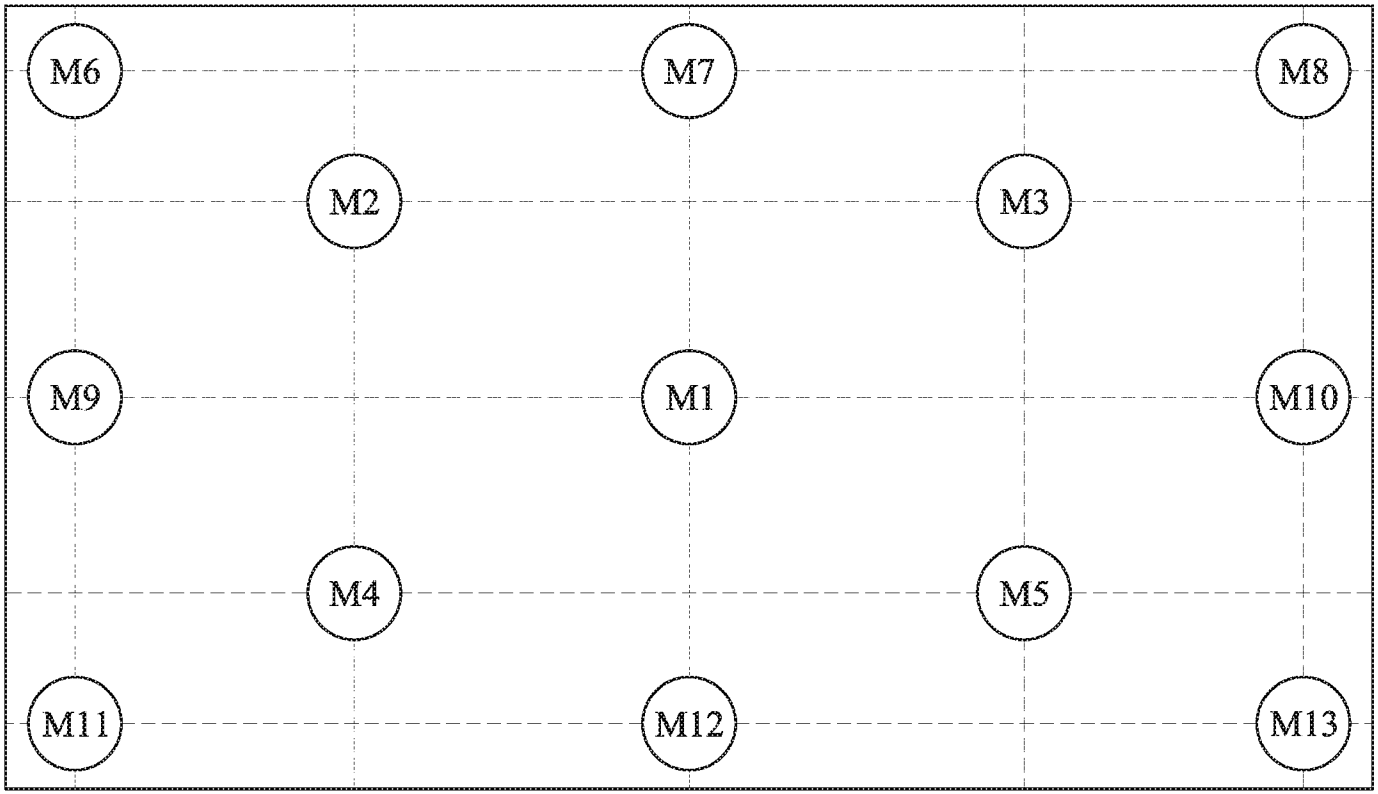

FIG. 4*a* and FIG. 4*b* illustrate diagrams of a method for measuring uniformity of brightness of the display panel 120 according to some embodiments of the present disclosure. The method for measuring uniformity of brightness of the display panel 120 follows the display measurement standard established by the Video Electronics Standards Association (VESA). The method for measuring uniformity of brightness of the display panel 120 may be one of a 5-point uniformity test (as shown in FIG. 4*a*), a 9-point uniformity test, a 13-point uniformity test (as shown in FIG. 4*b*), a 25-point uniformity test, etc. As shown in FIG. 4*a*, the display panel 120 has 5 measuring points M1-M5. As shown in FIG. 4*b*, the display panel 120 has 13 measuring points M1-M13. In step 1100, a method that the brightness sensor 130 uses to measure the uniformity of brightness of the display panel 120 when the display panel 120 displays the white picture includes: plural brightness values respectively corresponding to 5 measuring points M1-M5 or 13 measuring points M1-M13 of the display panel 120 are measured when the display panel 120 is lit up (i.e., the display panel 120 displays the white picture), the uniformity of brightness of the display panel 120 is obtained by calculating a ratio of a maximum value of the brightness values to a minimum value of the brightness values respectively corresponding to the 5 measuring points M1-M5 or the 13 measuring points M1-M13 of the display panel 120 is calculated, and thus the ratio is utilized for determining whether the brightness distribution of the display panel 120 is uniform. In some embodiments of the present disclosure, the uniformity of brightness of the display panel 120 may also be a ratio of a minimum value of the brightness values to a maximum value of the brightness values respectively corresponding to the measuring points of the display panel 120.

In step 1200, the ratio is compared with a uniformity threshold to determine whether the brightness distribution of the display panel 120 is uniform. When the brightness distribution of the display panel 120 is determined to be uniform, the step 1600 is performed. When the brightness distribution of the display panel 120 is determined to be not uniform, the step 1300 is performed. The uniformity threshold may be a preset value or an acceptable value set by a supplier. For example, when the ratio is less than the uniformity threshold, the brightness distribution of the display panel 120 is determined to be not uniform. For example, when the ratio is not less than the uniformity threshold, the brightness distribution of the display panel 120 is determined to be uniform.

In step 1300, (1) the upper odd regions U1 and the lower odd regions D1 of the display panel 120 are lit up; (2) the compensating calculator 140 controls the brightness sensor 130 to measure a central point brightness value that is a brightness value of a central point of each of the upper odd regions U1 and the lower odd regions D1 when the each of the upper odd regions U1 and the lower odd regions D1 is lit up; (3) the compensating calculator 140 controls the local dimming controller 150 to perform brightness compensation on one of the upper odd regions U1, or on one of the lower odd regions D1, so as to calculate the brightness compensation value corresponding to the one of the upper odd regions U1 or the one of the lower odd regions D1 when the central point brightness value of the one of the upper odd regions U1 or the one of the lower odd regions D1 is not equal to a standard value.

In some embodiments of the present disclosure, the compensating calculator 140 controls the local dimming controller 150 to perform brightness compensation on the one of the upper odd regions U1 or on the one of the lower odd regions D1 so as to allow the central point brightness value of the one of the upper odd regions U1 or the one of the lower odd regions D1 to be equal to the standard value. The standard value may be a preset value or an acceptable value set by a supplier. The brightness compensation value corresponding to the one of the upper odd regions U1 or the one of the lower odd regions D1 is the driving current (driving current parameter) of the LEDs of the first light source groups L1 or the second light source groups L2 corresponding to the one of the upper odd regions U1 or the one of the lower odd regions D1 when the edge-type backlight assembly 110 performs local dimming on the one of the upper odd regions U1 or on the one of the lower odd regions D1.

When the driving current of the LEDs of the first light source groups L1 or the second light source groups L2 corresponding to each of the upper odd regions U1 and the lower odd regions D1 falls between a maximum driving current value and a minimum driving current value of LEDs, the display apparatus including the edge-type backlight assembly 110 and the display panel 120 is determined to be compensable, and then the step 1400 is performed. When the driving current of the LEDs of the first light source groups L1 or the second light source groups L2 corresponding to each of the upper odd regions U1 and the lower odd regions D1 exceeds the maximum driving current value of LEDs (exceeds a maximum compensation range) or is less than the minimum driving current value of LEDs, the display apparatus including the edge-type backlight assembly 110 and the display panel 120 is determined to be not compensable, and then the step 1500 is performed. In step 1500, the compensating calculator 140 determines that the display apparatus including the edge-type backlight assembly 110 and the display panel 120 is unqualified (NG).

In step 1400, (1) the upper even regions U2 and the lower even regions D2 of the display panel 120 are lit up; (2) the compensating calculator 140 controls the brightness sensor 130 to measure a central point brightness value of each of the upper even regions U2 and the lower even regions D2 which is lit up; (3) the compensating calculator 140 controls the local dimming controller 150 to perform brightness compensation on one of the upper even regions U2 or on one of the lower even regions D2 so as to calculate the brightness compensation value corresponding to the one of the upper even regions U2 or the one of the lower even regions D2 when the central point brightness value of the one of the upper even regions U2 or the one of the lower even regions D2 is not equal to the standard value.

In some embodiments of the present disclosure, the compensating calculator 140 controls the local dimming controller 150 to perform brightness compensation on the one of the upper even regions U2 or on the one of the lower even regions D2 so as to allow the central point brightness value of the one of the upper even regions U2 or the one of the lower even regions D2 to be equal to the standard value. The brightness compensation value corresponding to the one of the upper even regions U2 or the one of the lower even regions D2 is the driving current (driving current parameter) of the LEDs of the first light source groups L1 or the second light source groups L2 corresponding to the one of the upper even regions U2 or the one of the lower even regions D2 when the edge-type backlight assembly 110 performs local dimming on the one of the upper even regions U2 or on the one of the lower even regions D2.

When the driving current of the LEDs of the first light source groups L1 or the second light source groups L2 corresponding to each of the upper even regions U2 and the lower even regions D2 falls between the maximum driving current value and the minimum driving current value of LEDs, the display apparatus including the edge-type backlight assembly 110 and the display panel 120 is determined to be compensable, and then the step 1200 is performed again, the local dimming controller 150 drives the edge-type backlight assembly 110 in a local dimming manner according to the brightness compensation values obtained in step 1300 and step 1400, in which each of the brightness compensation values are respectively corresponding to each of the regions (the upper odd regions U1, the lower odd regions D1, the upper even regions U2, and the lower even regions D2) of the display panel 120, the ratio of a minimum value of the brightness values to a maximum value of the brightness values is compared with the uniformity threshold again to determine whether the brightness distribution of the display panel 120 is uniform. When the driving current of the LEDs of the first light source groups L1 or the second light source groups L2 corresponding to each of the upper even regions U2 and the lower even regions D2 exceeds the maximum driving current value of LEDs (exceeds a maximum compensation range) or is less than the minimum driving current value of LEDs, the display apparatus including the edge-type backlight assembly 110 and the display panel 120 is determined to be not compensable, and then the step 1500 is performed. In step 1500, the compensating calculator 140 determines that the display apparatus including the edge-type backlight assembly 110 and the display panel 120 is unqualified (NG).

When the brightness distribution of the display panel 120 is determined to be uniform in step 1200, the step 1600 is performed. In step 1600, the brightness compensation values respectively corresponding to the upper odd regions U1, the lower odd regions D1, the upper even regions U2, and the lower even regions D2 are written into a storage unit 152 of the local dimming controller 150. In other words, the storage unit 152 of the local dimming controller 150 is configured to store the brightness compensation value corresponding to each of the regions (the upper odd regions U1, the lower odd regions D1, the upper even regions U2, and the lower even regions D2) of the display panel 120.

After the step 1600 is performed, the step 1700 is performed. In step 1700, the compensating calculator 140 determines that the display apparatus including the edge-type backlight assembly 110 and the display panel 120 is qualified (PASS).

Figure 5:
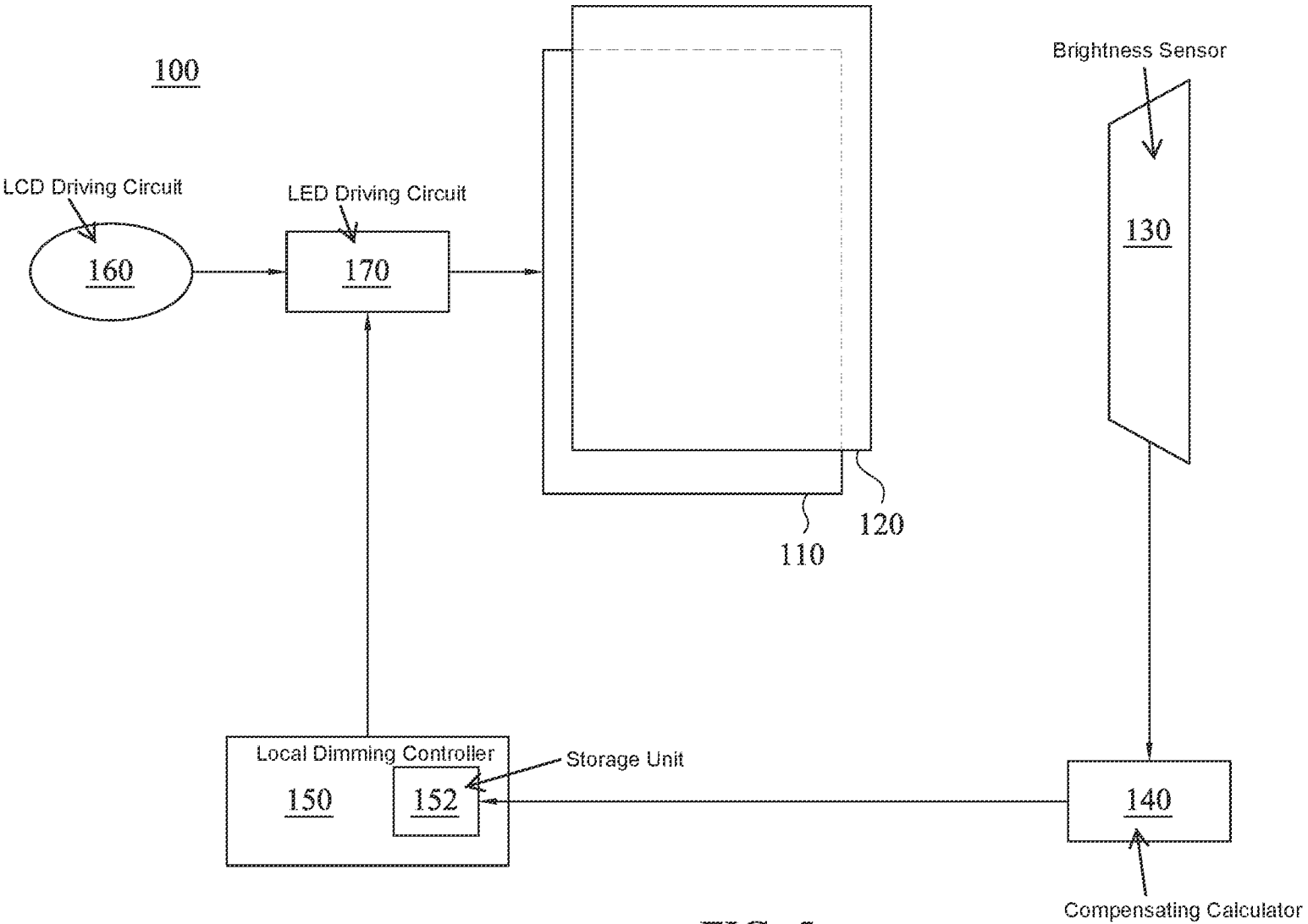
FIG. 5 illustrates a detailed diagram of the system for compensating uniformity of brightness according to some embodiments of the present disclosure.

FIG. 5 illustrates a detailed diagram of the system 100 for compensating uniformity of brightness according to some embodiments of the present disclosure. In comparison with FIG. 1, FIG. 5 further shows that the system 100 for compensating uniformity of brightness further includes a LCD driving circuit 160 and a LED driving circuit 170. The LCD driving circuit 160 is configured to drive the display panel 120. The local dimming controller 150 provides the brightness compensation value (driving current parameter) corresponding to each of the regions (the upper odd regions U1, the lower odd regions D1, the upper even regions U2, and the lower even regions D2) of the display panel 120 to the LED driving circuit 170, such that the LED driving circuit 170 may output different driving currents to the corresponding LEDs of the first light source groups L1 or the second light source groups L2, thereby realizing local dimming operation.

From the above description, one of the effects of the present disclosure is to adopt the local dimming manner for performing calibration so as to improve the product yield. The present disclosure utilizes the brightness sensor to measure the brightness of each of regions of the display panel, and utilizes the local dimming manner to adjust the brightness of each of regions of the display panel, and therefore the present disclosure may repair the products with poor uniformity of brightness. In addition, the present disclosure may optimize the maximum brightness of the product and improve the contrast of the product. Further, the present disclosure may effectively improve the display image quality of the product. The other effect of the present disclosure is that a specific block that needs to perform brightness compensation can be found more accurately by dividing the display panel into plural blocks, and the brightness value of the specific block may be adjusted by local dimming. Another effect of the present disclosure is that brightness compensation is performed on each of the region of the display in a local dimming manner, such that the defective parts of the product may be effectively improved and the product yield improved, and therefore the product may be easier to pass the high-quality test specifications such as HDR 400/600/100, etc.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A system for compensating uniformity of brightness, comprising:

an edge-type backlight assembly;

a display panel disposed above the edge-type backlight assembly, wherein the display panel comprises a plurality of regions for local dimming;

a brightness sensor configured to measure whether a brightness distribution of the display panel is uniform and measure a central point brightness value of each of the regions;

a compensating calculator configured to calculate a brightness compensation value corresponding to each of the regions of the display panel when the brightness distribution of the display panel is not uniform by:

controlling the brightness sensor to measure the central point brightness value of a first subset of the regions lit up during a first time interval when the brightness distribution of the display panel is not uniform; and controlling the brightness sensor to measure the central point brightness value of a second subset of the regions lit up during a second time interval when the brightness distribution of the display panel is not uniform, the second time interval different than the first time interval; and a local dimming controller configured to drive the edge-type backlight assembly according to the brightness compensation value corresponding to each of the regions of the display panel.

2. The system of claim 1, wherein the local dimming controller comprises a storage unit configured to store the brightness compensation value corresponding to each of the regions of the display panel.

3. The system of claim 1, wherein:

the display panel has a plurality of measuring points, and a method that the brightness sensor uses to measure whether the brightness distribution of the display panel is uniform comprises:

measuring a plurality of brightness values respectively corresponding to the measuring points which are lit up;

calculating a ratio of a maximum value of the brightness values to a minimum value of the brightness values; and comparing the ratio with a uniformity threshold to determine whether the brightness distribution of the display panel is uniform.

4. The system of claim 1, wherein:

the edge-type backlight assembly comprises a light guide plate, an upper light bar, and a lower light bar, the upper light bar and the lower light bar are respectively disposed on two opposite sides of the light guide plate, a light generated by the upper light bar and the lower light bar is guided to the display panel via the light guide plate, each of the upper light bar and the lower light bar has a plurality of first light source groups and a plurality of second light source groups arranged alternately along an extending direction of the upper light bar and the lower light bar, and each of the first light source groups and the second light source groups comprises at least one light-emitting diode (LED).

5. The system of claim 4, wherein the regions of the display panel comprise:

a plurality of upper odd regions corresponding to the first light source groups of the upper light bar;

a plurality of upper even regions corresponding to the second light source groups of the upper light bar;

a plurality of lower odd regions corresponding to the first light source groups of the lower light bar; and a plurality of lower even regions corresponding to the second light source groups of the lower light bar.

6. The system of claim 5, wherein:

controlling the brightness sensor to measure the central point brightness value of the first subset of the regions lit up during the first time interval when the brightness distribution of the display panel is not uniform comprises controlling, by the compensating calculator, the brightness sensor to measure the central point brightness value of each of the upper odd regions and the lower odd regions which is lit up during the first time interval, and a method that the compensating calculator uses to calculate the brightness compensation value corresponding to each of the regions of the display panel comprises:

controlling, by the compensating calculator, the local dimming controller to perform brightness compensation on one of the upper odd regions or on one of the lower odd regions so as to calculate the brightness compensation value corresponding to the one of the upper odd regions or the one of the lower odd regions when the central point brightness value of the one of the upper odd regions or the one of the lower odd regions is not equal to a standard value.

7. The system of claim 6, wherein:

controlling the brightness sensor to measure the central point brightness value of the second subset of the regions lit up during the second time interval when the brightness distribution of the display panel is not uniform comprises:

controlling, by the compensating calculator, the brightness sensor to measure the central point brightness value of each of the upper even regions and the lower even regions which is lit up, and the method that the compensating calculator uses to calculate the brightness compensation value corresponding to each of the regions of the display panel further comprises:

controlling, by the compensating calculator, the local dimming controller to perform brightness compensation on one of the upper even regions or on one of the lower even regions so as to calculate the brightness compensation value corresponding to the one of the upper even regions or the one of the lower even regions when the central point brightness value of the one of the upper even regions or the one of the lower even regions is not equal to the standard value.

8. The system of claim 7, wherein:

the compensating calculator controls the local dimming controller to perform brightness compensation on the one of the upper odd regions or on the one of the lower odd regions so as to allow the central point brightness value of the one of the upper odd regions or the one of the lower odd regions to be equal to the standard value, and the compensating calculator controls the local dimming controller to perform brightness compensation on the one of the upper even regions or on the one of the lower even regions so as to allow the central point brightness value of the one of the upper even regions or the one of the lower even regions to be equal to the standard value.

9. The system of claim 1, wherein when the brightness compensation value corresponding to one of the regions of the display panel exceeds a maximum compensation range, the compensating calculator determines that a display apparatus comprising the edge-type backlight assembly and the display panel is unqualified.

10. The system of claim 1, wherein the brightness compensation value corresponding to one of the regions of the display panel is a driving current parameter of the edge-type backlight assembly.

11. A method for compensating uniformity of brightness, comprising:

measuring, by a brightness sensor, whether a brightness distribution of a display panel is uniform, wherein the display panel comprises a plurality of regions for local dimming;

measuring a central point brightness value of each of a first subset of the regions during a first time interval when the brightness distribution of the display panel is not uniform;

measuring a central point brightness value of each of a second subset of the regions during a second time interval when the brightness distribution of the display panel is not uniform, the second time interval different than the first time interval;

calculating, by a compensating calculator, a brightness compensation value corresponding to each of the regions of the display panel when the brightness distribution of the display panel is not uniform; and driving, by a local dimming controller, an edge-type backlight assembly according to the brightness compensation value corresponding to each of the regions of the display panel, wherein the display panel is disposed above the edge-type backlight assembly.

12. The method of claim 11, comprising storing, in a storage unit of the local dimming controller, the brightness compensation value corresponding to each of the regions of the display panel.

13. The method of claim 11, wherein:

the display panel has a plurality of measuring points, and measuring, by the brightness sensor, whether the brightness distribution of the display panel is uniform comprises:

measuring a plurality of brightness values respectively corresponding to the measuring points which are lit up;

calculating a ratio of a maximum value of the brightness values to a minimum value of the brightness values; and comparing the ratio with a uniformity threshold to determine whether the brightness distribution of the display panel is uniform.

14. The method of claim 11, wherein:

the edge-type backlight assembly comprises a light guide plate, an upper light bar, and a lower light bar, the upper light bar and the lower light bar are respectively disposed on two opposite sides of the light guide plate, the method comprises guiding a light generated by the upper light bar and the lower light bar to the display panel via the light guide plate, each of the upper light bar and the lower light bar has a plurality of first light source groups and a plurality of second light source groups arranged alternately along an extending direction of the upper light bar and the lower light bar, and each of the first light source groups and the second light source groups comprises at least one light-emitting diode (LED).

15. The method of claim 14, wherein the regions of the display panel comprise:

a plurality of upper odd regions corresponding to the first light source groups of the upper light bar;

a plurality of upper even regions corresponding to the second light source groups of the upper light bar;

a plurality of lower odd regions corresponding to the first light source groups of the lower light bar; and a plurality of lower even regions corresponding to the second light source groups of the lower light bar.

16. The method of claim 15, wherein:

measuring the central point brightness value of each of the first subset of the regions during the first time interval when the brightness distribution of the display panel is not uniform comprises:

controlling, by the compensating calculator, the brightness sensor to measure the central point brightness value of each of the upper odd regions and the lower odd regions which is lit up, and calculating, by the compensating calculator, the brightness compensation value corresponding to each of the regions of the display panel comprises:

controlling, by the compensating calculator, the local dimming controller to perform brightness compensation on one of the upper odd regions or on one of the lower odd regions so as to calculate the brightness compensation value corresponding to the one of the upper odd regions or the one of the lower odd regions when the central point brightness value of the one of the upper odd regions or the one of the lower odd regions is not equal to a standard value.

17. The method of claim 16, wherein:

measuring the central point brightness value of each of the second subset of the regions during the second time interval when the brightness distribution of the display panel is not uniform comprises:

after the local dimming controller performs brightness compensation on the upper odd regions and the lower odd regions, controlling, by the compensating calculator, the brightness sensor to measure the central point brightness value of each of the upper even regions and the lower even regions which is lit up, and calculating, by the compensating calculator, the brightness compensation value corresponding to each of the regions of the display panel further comprises:

controlling, by the compensating calculator, the local dimming controller to perform brightness compensation on one of the upper even regions or on one of the lower even regions so as to calculate the brightness compensation value corresponding to the one of the upper even regions or the one of the lower even regions when the central point brightness value of the one of the upper even regions or the one of the lower even regions is not equal to the standard value.

18. The method of claim 17, wherein:

the compensating calculator controls the local dimming controller to perform brightness compensation on the one of the upper odd regions or on the one of the lower odd regions so as to allow the central point brightness value of the one of the upper odd regions or the one of the lower odd regions to be equal to the standard value, and the compensating calculator controls the local dimming controller to perform brightness compensation on the one of the upper even regions or on the one of the lower even regions so as to allow the central point brightness value of the one of the upper even regions or the one of the lower even regions to be equal to the standard value.

19. The method of claim 11, wherein when the brightness compensation value corresponding to one of the regions of the display panel exceeds a maximum compensation range, the method comprises determining, by the compensating calculator, that a display apparatus comprising the edge-type backlight assembly and the display panel is unqualified.

20. The method of claim 11, wherein the brightness compensation value corresponding to one of the regions of the display panel is a driving current parameter of the edge-type backlight assembly.

* * * * *